US005597323A

United States Patent [19]

Resnick et al.

[11] Patent Number: 5,597,323

[45] Date of Patent: Jan. 28, 1997

[54] RF CONNECTOR JACK AND PLUG ASSEMBLY

[75] Inventors: Paul Resnick, Roxborough; Hubert Chow, Lexington, both of Mass.

[73] Assignee: The Whitaker Corporation, Wilmington, Del.

[21] Appl. No.: 512,030

[22] Filed: Aug. 7, 1995

[51] Int. Cl.[6] ..... H01R 4/24

[52] U.S. Cl. ..... 439/582; 439/578

[58] Field of Search ..... 439/578–585, 439/842, 816–819, 851, 841, 700

[56] References Cited

U.S. PATENT DOCUMENTS

| | | | |
|---|---|---|---|
| 4,588,249 | 5/1986 | Blichasz et al. | 339/97 |
| 4,614,926 | 9/1986 | Reed et al. | 333/244 |
| 4,671,598 | 6/1987 | Keehne | 439/610 |
| 4,678,261 | 7/1987 | Mitani et al. | 439/582 |
| 4,701,001 | 10/1987 | Verhoeven | 439/394 |
| 4,708,414 | 11/1987 | Lam | 439/394 |
| 4,746,307 | 5/1988 | Joly et al. | 439/394 |
| 4,747,786 | 5/1988 | Hayashi et al. | 439/95 |
| 4,772,222 | 9/1988 | Laudig et al. | 439/578 |
| 4,797,121 | 1/1989 | Hayward | 439/579 |
| 4,861,271 | 8/1989 | Bogar et al. | 439/63 |
| 4,881,912 | 11/1989 | Thommen et al. | 439/585 |
| 5,061,206 | 10/1991 | Kawanami et al. | 439/582 |
| 5,078,621 | 1/1992 | Nishikawa et al. | 439/581 |
| 5,110,308 | 5/1992 | Nishikawa et al. | 439/582 |
| 5,131,868 | 7/1992 | Forterre | 439/582 |
| 5,263,877 | 11/1993 | Mitani | 439/582 |
| 5,322,453 | 6/1994 | Resnick et al. | 439/581 |

*Primary Examiner*—David L. Pirlot

[57] ABSTRACT

A jack and plug assembly wherein the jack has downwardly extending inner and outer coaxial connectors, and is designed to receive a coaxial cable at a right angle to the axis of the jack, with the inner connector of a coaxial cable attached to the inner conductor. The inner connector of the jack comprises a downwardly extending hollow cylindrical spring metal conductor, with the upper portion of the conductor having a surface hole of a size slightly smaller than the diameter of the inner conductor of the coaxial cable to be connected thereto. A lower portion of the hollow cylinder below the hole is removed and the surface of the hollow cylinder between the top and the lower portion is slotted to permit forcible expansion of the upper portion so that the hole is enlarged sufficiently to receive the larger inner conductor of the coaxial cable.

10 Claims, 4 Drawing Sheets

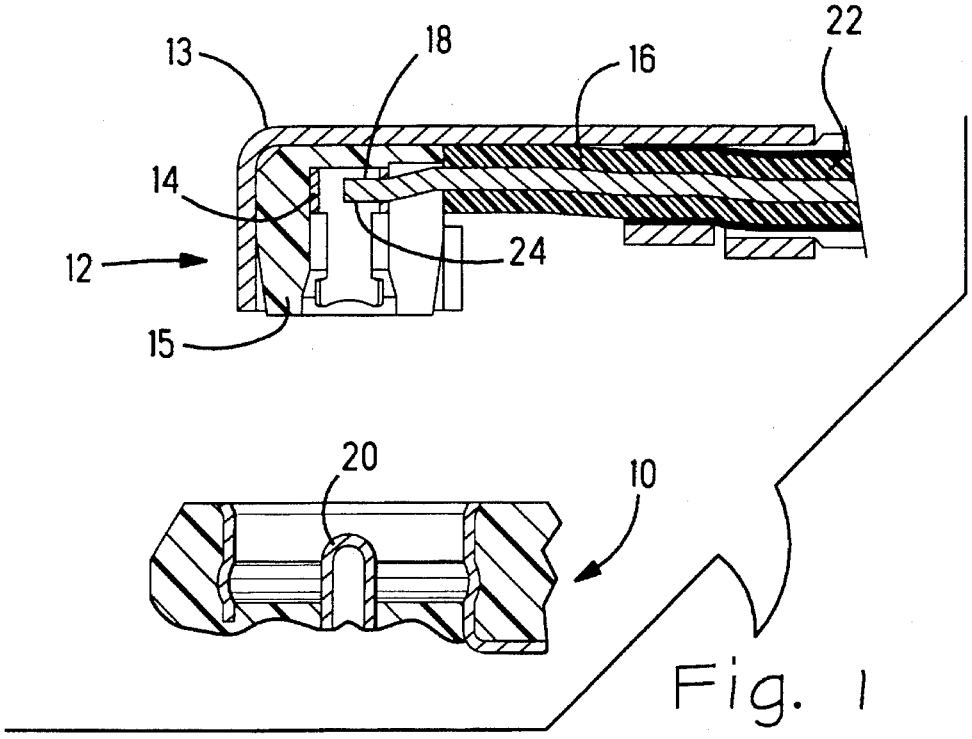
Fig. 1
Fig. 2
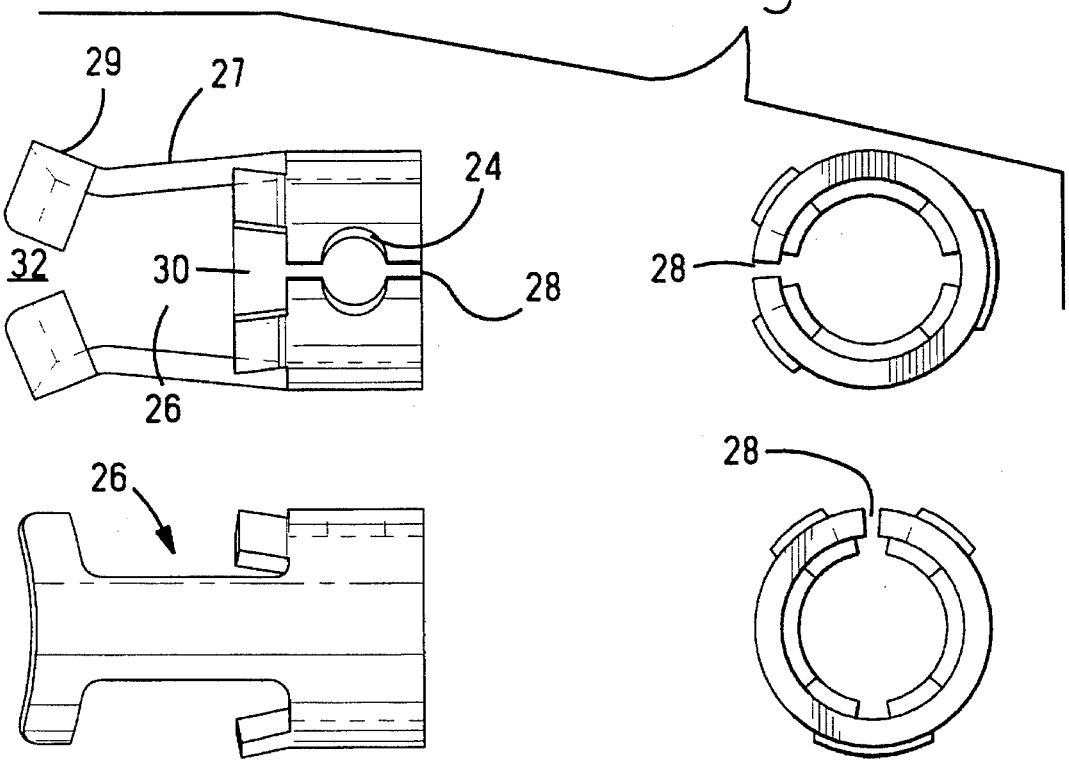

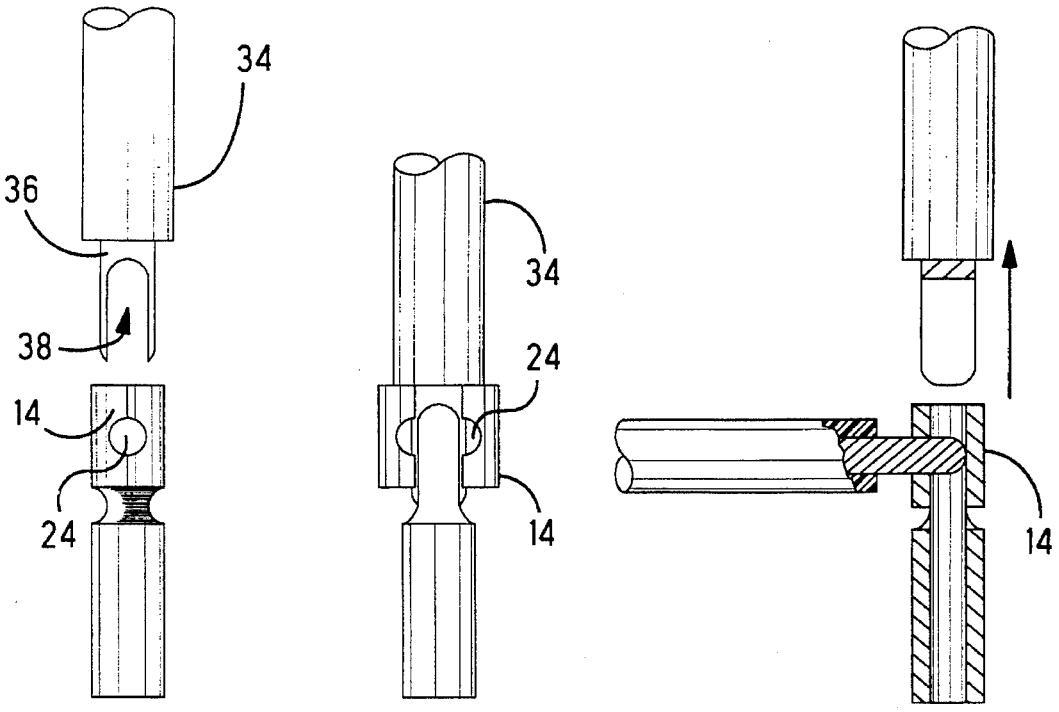
Fig.4A Fig.4B Fig.4E
Fig. 4
Fig.4C Fig.4D
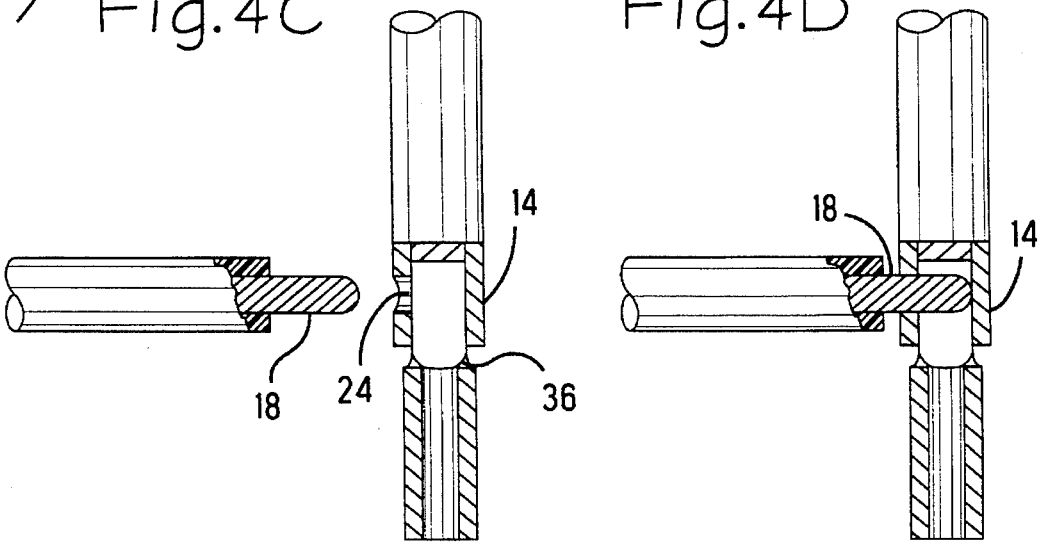

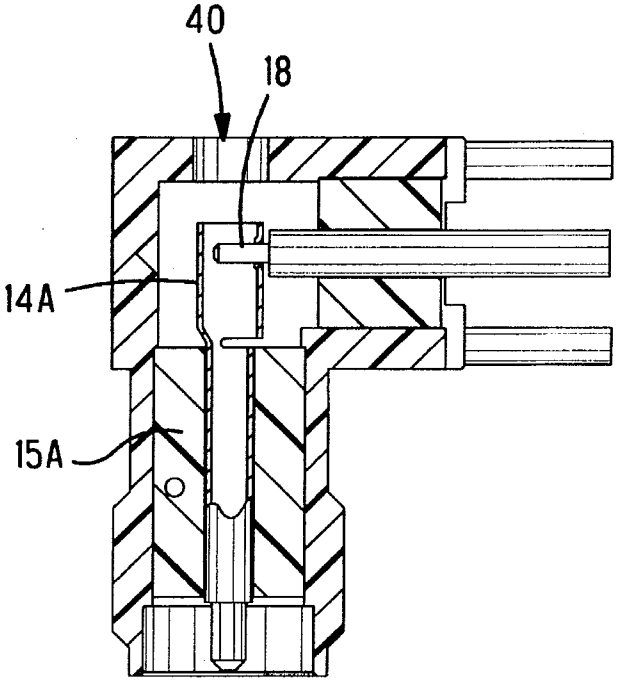
Fig.6A
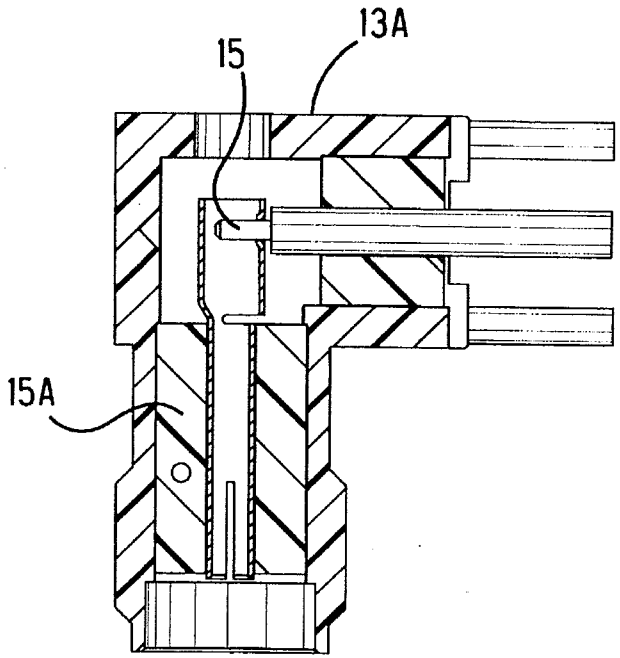
Fig.6B
Fig. 6

RF CONNECTOR JACK AND PLUG ASSEMBLY

FIELD OF THE INVENTION

The present invention generally relates to a miniature plug and jack assembly.

BACKGROUND OF THE INVENTION

An earlier patent (U.S. Pat. No. 5,322,453) assigned to the assignee of the present invention has described an rf connector jack assembly which has a particularly useful construction for miniature plug and jack assemblies. The inner conductor of the coax is normally connected to the inner jack conductor by using laser welds or other techniques of this kind. These methods are slow in production and generally expensive to utilize.

Another prior art U.S. Pat. No. 5,110,308 discloses a jack assembly where the inner conductor of a coax can be pressed into a metal slit on the inner conductor of the jack. While this is a simpler system than using the welding techniques common in the prior art, it has the disadvantage that the assembly cannot readily be disassembled, if necessary, for repairs, etc., and once the wire has been assembled in the slit it can come loose during subsequent assembly operations.

BRIEF DESCRIPTION OF THE INVENTION

In the present invention the inner cylindrical conductor of the jack assembly includes a round hole in its side to receive the core solid conductor of the coax to be connected thereto. This hole is preferably made slightly smaller than the diameter of the coax core conductor so as to make a firm electrical and mechanical connection between the two. In order to insert the core conductor of the coax into the inner cylindrical conductor thereto it is necessary to expand the hole to permit passage of the core conductor therethrough. This is achieved by the use of an expansion tool which is larger than the inner diameter of the cylindrical inner conductor and which expands this cylindrical inner conductor to open up the hole when the expansion tool is pressed down the interior of the cylindrical conductor.

BRIEF DESCRIPTION OF THE DRAWINGS

FIG. 1 illustrates one embodiment of the invention showing the jack assembly to be used in conjunction with a plug assembly of the type shown in the '453 patent.

FIG. 2 illustrates an inner cylindrical conductor which has been modified to embody the present invention.

FIG. 4 is a schematic illustration showing a sequence of steps illustrating the process of inserting the expansion tool into the cylindrical inner conductor of the jack to permit insertion of the inner conductor of the coax into the expanded hole on the side of the cylindrical conductor to give a resulting structure after the expansion tool has been removed.

FIG. 6 shows two further embodiment of the present invention. FIG. 6A showing a male inner cylindrical conductor and FIG. 6B showing a female inner cylindrical conductor.

DETAILED DESCRIPTION OF THE INVENTION

Figure 3:
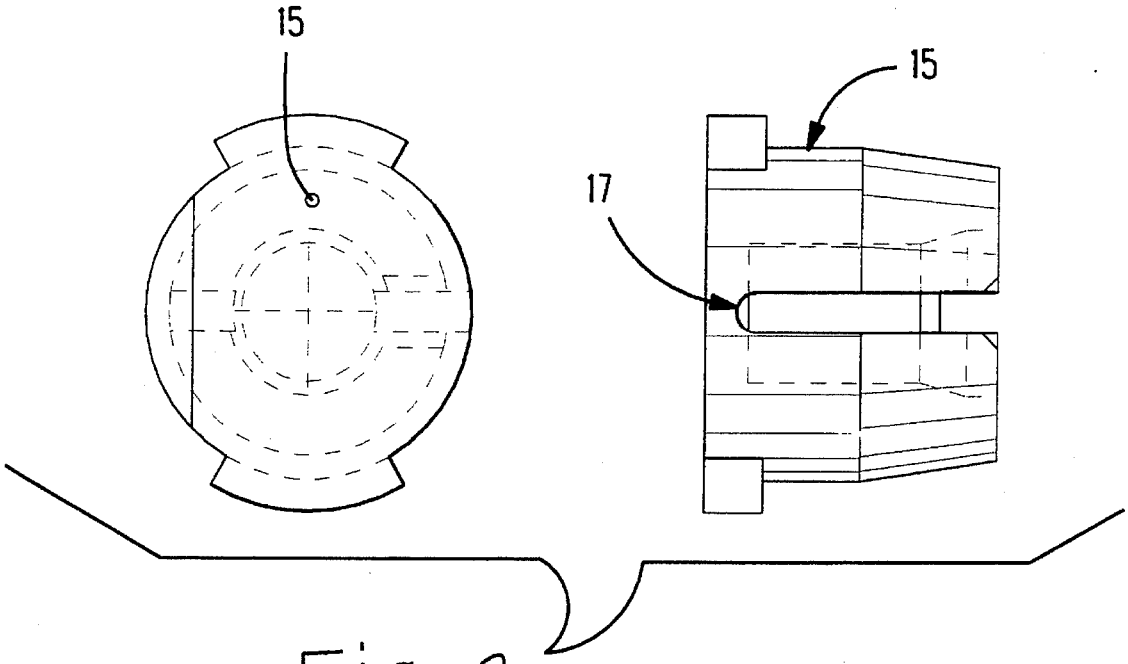
FIG. 3 illustrates a modified spacing insulator between the inner cylindrical conductor and the outer shield.

The principal modification to the construction of '453 is in the arrangement of the inner conductor 14 of the jack 12. This conductor is separated from outer housing 13 of the jack by an insulator 13 even in FIG. 3. The insulator 15 has a slot 17 to receive the inner conductor 18 carried by the coax 16. The cylindrical inner contact 14 in the jack is seen best in FIG. 2. As illustrated, an isolation section 26 is positioned below the hole 24 for receiving the end 18 of the inner conductor in the coax. This hole 24 is slightly smaller than the diameter of the inner conductor 18. The isolation section 26 below the hole 24 permits expansion of the upper section of the tubular conductor 14, generally independently of the lower section 27 of the inner conductor 14. Slot 28 between the hole 24 and the top of the cylindrical conductor 14, in conjunction with slot 30 below the hole 14, permits expansion of the hole when a suitable tool is inserted inside the hollow cylindrical conductor 14. A separate slot 32, which can be on the same plane as the slots 29 and 30, (but does not have to be) is provided at the bottom of the tubular conductor to permit spring engagement of the inner conductor of the jack with the inner conductor 20 of the plug.

Referring now briefly to FIG. 4 there is shown a schematic series of drawings illustrating the operation of an expansion tool 34 having a tip 36 (which is preferably tapered) containing a slot 38. As shown in FIG. 4B when the tool 34 is inserted in the upper end of the cylindrical conductor 14 the top 36 expands the hole 24. This permits insertion of the inner conductor 18 of the coax through the hole 24 as seen in the preparatory position FIG. 4C and the insertion position of diagram FIG. 4D. The inner conductor 18 is positioned in place within the tubular conductor 14 while the expansion tool is still in position. In FIG. 4E the expansion tool has been withdrawn and hole 14 has been closed to its minimum size, making a firm electrical and mechanical contact with the inner conductor 18. This details the sequence of steps for inserting the inner conductor 18 into the hole 24 and locking this inner conductor 18 within the inner conductor 14.

Thereafter the insulator 15 is slid over the upper end of the inner cylindrical conductor 14, the slot 17 permitting passage of this insulator over the coax conductor 18. Thereafter the outer housing 13 is installed over the insulator in the general manner shown in the '453 patent. The above sequence of events is reversed if the coax is to be disconnected.

Figure 5:
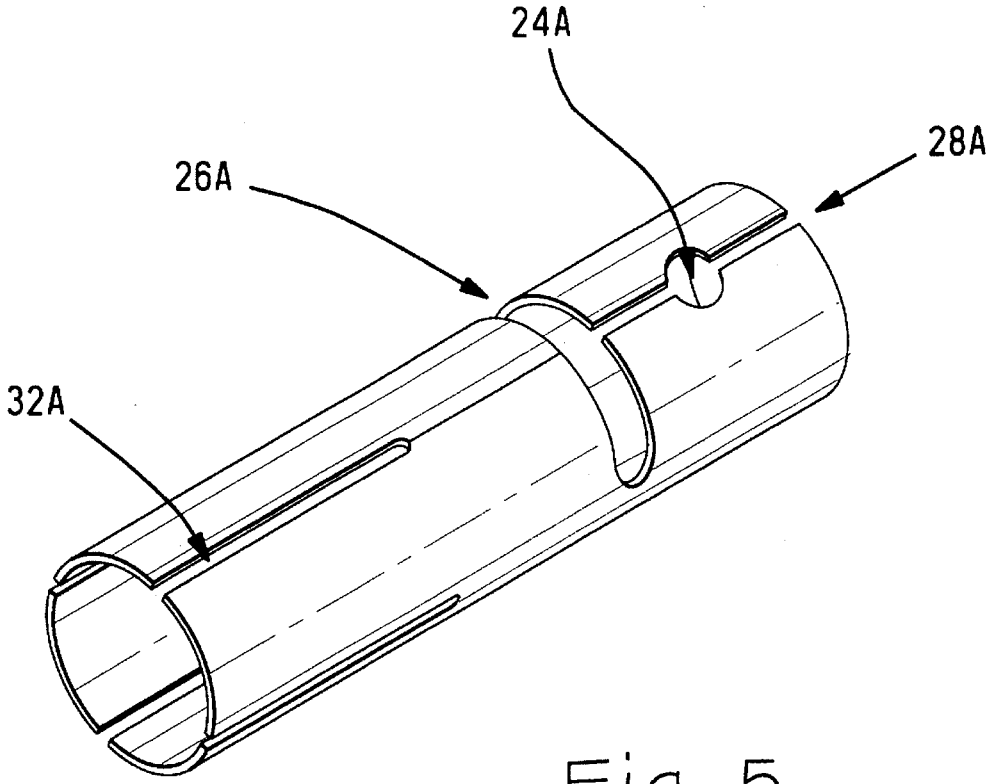
FIG. 5 shows a slightly simplified cylindrical inner conductor for the jack.

Referring now to FIG. 5 and 6 there is shown a slightly modified inner conductor 14A for the jack. In this case it is a simple tube having a hole 24A, an upper slot 28A, a lower slot 30A, and a bottom slot 32A. The isolation slot 26A permits independent expansion of the upper portion of the tube 14A without expanding the lower portion.

FIGS. 6*a* and 6*b* shows modification to the right angle connection of '453 wherein an inner cylindrical conductor of the type shown in FIG. 5 in mounted and insulator 15A and positioned within a housing 13A. In this case, the housing 13A has a hole 40 in the top thereof through which an expansion tool can be inserted. In this case, the inner tubular conductor can be supported by the insulator 15A. The inner conductor 18 can be inserted from the right hand side as shown in 6A when the inner conductor 14A has been expanded by the expansion tool inserted through the hole 40. After the inner conductor 18 is in position in the hole 40 the expansion tool is removed, locking the inner conductor in position. If the inner conductor is to be changed or disconnected, the expansion tool can be re-inserted in the hole 40 and the inner conductor 18 can be released from the tubular conductor 14A. The hole 40 can be plugged as desired, to provide complete shielding, if needed.

In a preferred embodiment of the invention the cylindrical inner conductor 14 is formed of Beryllium copper, a metal commonly used for electrical contracts.

There are variations which may be made by the skilled artisan to the present invention not expressly disclosed herein, which nevertheless are within the spirit of the invention and the scope of the claims. For example, the coax may be connected at an angle more or less than 90° and the cylindrical connector 14 may deviate from a pure cylinder without departing from the spirit of the invention.

We claim:

1. In a jack and plug assembly, the jack having downwardly extending inner and outer coaxial connectors, the jack being designed to receive a coaxial cable at a right angle to the axis of the jack, with the inner conductor of a coaxial cable attached to the inner connector, the improvement wherein said inner connector comprises a downwardly extending hollow cylindrical spring metal conductor, the upper portion of said conductor having a surface hole of a size slightly smaller than the diameter of the inner conductor of the coaxial cable to be connected thereto, a lower portion of the hollow cylinder below the hole being removed and the surface of the hollow cylinder between the top and the lower portion being slotted to permit forcible expansion of the upper portion so that the hole is enlarged sufficiently to receive the larger inner conductor of the coaxial cable.

2. The assembly of claim 1, wherein the slot passes through the hole axis in a plane parallel to the cylinder axis.

3. The assembly of claim 1, wherein at least 90° of the surface of said cylinder on each side of a plane passing through the hole axis and parallel to the cylinder axis is removed.

4. The assembly of claim 1, wherein the hole axis is perpendicular to cylinder axis.

5. The assembly of claim 4, wherein the slot is in a plane which passes through a diameter of the hole.

6. The assembly of claim 1, wherein at least 180° of surface of said cylindrical conductor is removed.

7. The assembly of claim 6, wherein at least 45° of the surface of said cylinder on each side of a plane passing through the hole axis and parallel to the cylinder axis is removed.

8. The assembly of claim 1, wherein said cylindrical conductor is slotted along its entire length.

9. The combination of the assembly of claim 1, and an expansion tool having an axial slot slightly larger than the diameter of the inner conductor of the coax and an outer diameter sufficiently larger than inner diameter of the cylindrical inner conductor of the jack to expand the cylindrical conductor, and the hole on its surface, sufficiently to permit entry of the inner conductor of the coax into the hole.

10. Process of manufacturing a jack, the jack having downwardly extending inner and outer coaxial connectors, the jack being designed to receive a coaxial cable at a right angle to the axis of the jack, with the inner conductor of a coaxial cable attached to the inner connector, said inner connector comprises a downwardly extending hollow cylindrical spring metal conductor, the upper portion of said conductor having a surface hole of a size slightly smaller than the diameter of the inner conductor of the coaxial cable to be connected thereto, comprising the steps of inserting an expansion tool into the upper portion of said hollow cylindrical conductor to forcibly expand the upper portion so that the hole is enlarged sufficiently to receive the larger inner conductor of the coaxial cable, inserting the coax inner conductor in the hole and removing the expansion tool to allow the hole to decrease in size and firmly clamp the coax inner conductor.

* * * * *